United States Patent [19]

Tomibe et al.

[11] Patent Number: 4,670,189

[45] **Date of Patent: * Jun. 2, 1987**

[54] ELECTRICALLY CONDUCTING MATERIAL AND PROCESS OF PREPARING SAME

[75] Inventors: Shinji Tomibe, Kyoto; Norio Murasaki, Kodaira, both of Japan

[73] Assignee: Nihon Sanmo Dyeing Co., Ltd., Japan

[ * ] Notice: The portion of the term of this patent subsequent to Dec. 3, 2002 has been disclaimed.

[21] Appl. No.: 736,778

[22] Filed: May 22, 1985

Related U.S. Application Data

[62] Division of Ser. No. 461,250, Jan. 26, 1983, Pat. No. 4,556,508.

[30] Foreign Application Priority Data

Feb. 5, 1982 [JP] Japan ..... 57-16264
Feb. 17, 1982 [JP] Japan ..... 57-222441

[51] Int. Cl.[4] ..... H01B 1/04; D06M 13/26; D06M 15/00

[52] U.S. Cl. ..... 252/514; 252/518; 8/115.51

[58] Field of Search ..... 252/518, 519, 514; 524/403, 413, 420, 423; 428/389, 394, 270, 290, 390; 8/115.51

[56] References Cited

FOREIGN PATENT DOCUMENTS 0644429 11/1927 France .

*Primary Examiner*—Paul Lieberman
*Assistant Examiner*—John F. McNally
*Attorney, Agent, or Firm*—Pahl, Lorusso & Loud

[57] ABSTRACT

An electrically conducting material including a cyanic group-containing substrate material and adsorbed sulfides of copper and an auxiliary metal selected from silver, gold and elements of the platinum group. The cyanic group-containing substrate may be in the form of powder or a shaped body such as a fiber, film, plate, rod or like. Suitable substrates include synthetic polymers such as polyacrylonitrile and polyamides having cyanic groups; naturally occurring polymeric substances such as cotton having introduced thereinto cyanic groups; and low molecular weight compounds such as phthalonitrile. The electrically conducting material may be prepared by treating the cyanic group-containing substrate with (a) a source of monovalent copper ions, (b) a source of ions containing the auxiliary metal and (c) a sulfur-containing compound to form sulfides of copper and the auxiliary metal adsorbed by the cyanic group-containing material.

13 Claims, No Drawings

ELECTRICALLY CONDUCTING MATERIAL AND PROCESS OF PREPARING SAME

This is a division of application Ser. No. 461,250 filed Jan. 26, 1983, now U.S. Pat. No. 4,556,508.

BACKGROUND OF THE INVENTION

1. Field of the Invention

This invention relates to electrically conducting materials and to a process for the preparation of such electrically conducting materials.

2. Description of the Prior Art

Numerous methods for imparting electrical conductivity to synthetic polymeric materials in the form of shaped bodies are known in the art. For example, in U.S. Pat. No. 3,940,533 issued to Arsac, there is proposed one method for imparting electrical conductivity to polymeric shaped materials such as polyamide fibers, in which the fibers are first contacted with hydrogen sulfide and the resulting fibers impregnated with the hydrogen sulfide are then immersed in a metal salt solution such as an aqueous copper sulfate solution, to form a deposit of metal sulfide, such as copper sulfide, on the fibers. This process, however, is not applicable to acrylic fibers. Moreover, the copper sulfide deposit on the fibers obtained according to this process is poor in stability, especially in washability, so that the electrical conductivity gradually decreases during use. In U.S. Pat. No. 4,336,028 (filed July 15, 1981) owned by Nihon Sanmo Dyeing Co., Ltd., there is disclosed a method for imparting electrical conductivity to acrylic fibers by impregnating the fibers with copper sulfide. Although the electrically conducting fibers obtained by this method exhibit far superior washability in comparison with those obtained according to the method of the above-mentioned U.S. Pat. No. 3,940,533, a further improvement in washability is still desired in practice.

SUMMARY OF THE INVENTION

The present invention provides an electrically conducting material which comprises a cyanic group-containing substrate carrying adsorbed sulfides of copper and an auxiliary metal selected from silver, gold and elements of the platinum group. Any cyanic group-containing material may be used as the substrate so far as it is a water-insoluble solid. The cyanic group-containing substrate material may be in the form of a shaped body such as fiber, film, block, plate or granule or in the form of powder. Not only acrylonitrile-series polymeric materials but also other synthetic or naturally occurring polymeric materials having cyanic groups introduced therein cyanic groups may be used as the starting material. In addition, low molecular weight compounds having one or more cyanic groups can be used as the cyanic group-containing material to which an electrical conductivity is imparted.

The electrically conducting material of this invention, when in the form of fibers, may be advantageously utilized in clothing, carpets, interior decorative sheets, gloves or the like by themselves or in combination with other fibers because of their static resistance and affinity for dyes. When in the form of a film or plate, the electrical conductivity and transparency of the materials of this invention allow use as covers and enclosures for electric parts such as integrated circuits and large-scale integrated circuits which require shielding from electrostatic charges during storage or transportation. The electrically conductive material of this invention may be incorporated as a powder into a coating composition to form electrically conductive coatings. Because of the excellent thermal stability of the sulfides, the powder or granules of the electrically conductive material of this invention formed from synthetic polymers, such as polyacrylonitrile, can be thermally molded to produce electrically conducting molded articles. Thus, the electrically conducting materials of this invention lend themselves to numerous applications in many fields.

In another aspect, the present invention provides a process for the preparation of the above described electrically conducting materials. The process includes treating a cyanic group-containing material with a source of monovalent copper ions, ions containing the auxiliary metal and a sulfur-containing compound to form sulfides of copper and the auxiliary metal adsorbed by the cyanic group-containing material.

In a further aspect, the present invention provides a method of reforming a copper sulfide-carrying, cyanic group-containing, electrically conducting material, which includes treating the material with ions containing the auxiliary metal and, optionally, with a sulfur-containing material.

It is, therefore, an object of the present invention to provide an electrically conducting material having excellent electrical conductivity, washability and resistance to heat, alkali and moisture.

Another object of the present invention is to provide a simple process which can impart excellent electrical conductivity to cyanic group-containing materials.

It is a further object of the present invention to provide a method for reforming a copper sulfide-carrying, electrically conducting, cyanic group-containing material to improve its washability.

Other objects, features and advantages of the present invention will become apparent from the detailed description of the invention to follow.

DETAILED DESCRIPTION OF THE INVENTION

The cyanic group-containing starting materials of the present invention include both polymeric and low molecular weight substances. Suitable cyanic group-containing polymeric substances include both natural and synthetic polymers.

Not only acrylonitrile-series polymeric substances such as polymers and copolymers (inclusive of random, block and graft copolymers) of acrylonitrile but also other polymeric substances such as polyamides and polyesters having introduced thereinto cyanic groups may be used as the synthetic polymers. The introduction of cyanic radicals into such synthetic polymers may be effected by any known method such as by reaction with dicyandiamide, graft polymerization of acrylonitrile onto the polymers, cyanoethylization, mixed spinning, graft polymerized material spinning, block copolymerized material spinning and the like. The synthetic polymers to be imparted with electrical conductivity may be in the form of powder or in the form of a shaped body such as a film, plate, fiber, fabric, paper, sheet, block, pellet, thread, rod or pipe and may contain the customarily used additives such as an ultraviolet ray-absorbers and molding aids.

The cyanic group-containing natural polymeric materials include polypeptides and polysaccharides, such as wool, silk and cotton, having introduced thereinto cyanic radicals. The introduction of cyanic radicals into such naturally occurring polymeric materials may be effected in any known manner such as those noted above. The cyanic group-containing natural polymers may be used in the form of powder or fibers.

Illustrative of the cyanic group-containing low molecular weight compounds are phthalonitrile, isophthalonitrile, N-cyanomethylaniline and N-β-cyanoethylaniline. These compounds are generally used in the form of powder.

The above-described cyanic group-containing material is subjected to a treatment with (a) a source of monovalent copper ions (b) a source of ions containing an auxiliary metal selected from the group consisting of silver, gold and elements of the platinum group and (c) a sulfur-containing compound to form sulfides of copper and the auxiliary metal adsorbed on and/or within the cyanic group-containing material. The platinum group elements usable here include ruthenium, rhodium, palladium, osmium, iridium and platinum.

As the source of monovalent copper ions, a combination of a bivalent copper compound, such as a salt or a complex of bivalent copper, and a reducing agent capable of converting the bivalent copper compound into monovalent copper ions is generally employed. Illustrative of suitable bivalent copper salts are cupric sulfate, cupric chloride, cupric nitrate and cupric acetate. Examples of the reducing agent include metallic copper, hydroxylamine or its salt, ferrous sulfate, ammonium vanadate, furfural, sodium hypophosphite and glucose. Cuprous salts or complexes may also be used as the source of monovalent copper ions.

The sulfur-containing compound used in the process of this invention is of a type which is capable of providing sulfur atoms and/or sulfur ions for reaction with the copper ions and the ions containing the auxiliary metal to form sulfides of copper and the auxiliary metal which are adsorbed on or within the cyanic group-containing material. Illustrative of the sulfur-containing materials are sodium sulfide, sulfur dioxide, sodium hydrogen sulfite, sodium pyrosulfite, sulfurous acid, dithionous acid, sodium dithionite, sodium thiosulfate, thiourea dioxide, hydrogen sulfide, sodium formaldehyde sulphoxylate (RONGALITE C), zinc formaldehyde sulphoxylate (RONGALITE Z) and mixtures thereof. Since these sulfur-containing compounds have a reducing activity and, accordingly they may serve as at least a part of the reducing agent for converting bivalent copper ions into monovalent ones.

As the source of ions containing the auxiliary metal, a salt or complex of the auxiliary metal, such as a sulfate, nitrate, chloride, acetate, benzoate, a thiocyanate complex or a thiosulfate complex, may be suitably employed.

The treatment with the components (a), (b) and (c) may be effected in the order of (I): (a)(b)(c), (a)(b)-(c), (a)-(b)(c), (a)-(b)-(c) and (b)-(a)-(c); and (II): (a)-(c)-(b)-(c), (a)-(c)-(b), (a)-(c)-(b)(c), (a)(c)-(b)(c), (a)(c)-(b), (a)(c)-(b)-(c). The methods of the former group (I) form sulfides of copper and the auxiliary metal simultaneously while the methods of the latter group (II) form copper sulfide prior to modification by the auxiliary metal component.

Among the group (I) methods, the first three are preferred from an economic point of view, i.e. it is preferable to conduct the treatment with the source of ions containing the auxiliary metal simultaneously with at least one of the treatments with the source of monovalent copper ions and sulfur-containing compound. When the treatments with the source of monovalent copper ions and the source of ions containing the auxiliary metal, and with the sulfur-containing compound are to be simultaneous ((a) (b) (c)), the cyanic group-containing material is immersed in a bath containing the source of monovalent copper ions, the source of ions containing the auxiliary metal and the sulfur-containing compound preferably at a temperature of 20° to 150° C., more preferably 30° to 100° C., generally for a period of time of 1 to 24 hours. When the reaction is conducted at an elevated temperature, it is preferred that the bath be gradually heated at a rate of 1° to 3° C./min. The pH of the bath is preferably maintained within the range of about 1.5 to 6, more preferably 3 to 5. For this purpose, a pH controlling agent may be used. Examples of the pH controlling agents include inorganic acids such as sulfuric acid, hydrochloric acid and phosphoric acid; organic acids such as citric acid and acetic acid; and mixtures thereof. It is possible to carry out the treatment at a low temperature when the pH is low.

In the embodiment of the present invention wherein the treatment with the sulfur-containing compound is preceded by the treatment with the source of monovalent copper ions and the source of ions containing the auxiliary metal ((a) (b)-(c)), the cyanic group-containing material is first immersed in a first bath containing the source of monovalent copper ions and the source of ions containing the auxiliary metal preferably at a temperature of 50° to 150° C., more preferably 80° to 110° C. for a period of time so that monovalent copper ions and ions containing the auxiliary metal are adsorbed by the cyanic group-containing material (first stage). The first stage reaction time is generally 0.5 to 2 hours. The pH of the first bath is preferably maintained within the range of 1 to 3 with the use of a pH controlling agent such as described above. As described previously, the treatment with monovalent copper ions may also be conducted prior to or after the treatment with the auxiliary metal-containing ions ((a)-(b)-(c) or (b)-(a)-(c)). In such a case, the conditions of the treatment are substantially the same as those described immediately above. However, such a method does not afford any specific advantage over the method in which the component (a) is used together with the component (b). The cyanic group-containing material from the first stage having the adsorbed monovalent copper ions and ions containing the auxiliary metal is then treated in a second bath containing the sulfur-containing compound (second stage). Preferably, the treated material from the first stage is washed with a suitable liquid such as water prior to the second treatment stage. The treatment in the second stage is preferably carried out at a temperature of 50° to 120° C., more preferably 70° to 100° C. The reaction time generally ranges from 1.5 to 4.5 hours. It is preferable to gradually heat the bath at a rate of 1° to 3° C./min. In the case where the second stage employs a gaseous sulfur-containing compound, the treated material from the first stage is contacted therewith at a pressure of 0.5 to 3 atm. at a temperature of 90° to 120° C. for 1 to 3 hours. In the case of a two stage method (a)-(b) (c), the reaction conditions are substantially the same as the previously described two stage method (a) (b)-(c).

In both the above single and two-stage treatments, the amount of the source of monovalent copper ions varies according to the intended degree of electrical conductivity, the content of cyanic groups in the starting material, the form of the starting material and the like. Generally, the source of monovalent copper ions is used in an amount of 2 to 15 g in terms of metallic copper per 100 g of the starting cyanic group-containing material. The concentration of the source of monovalent copper ions in the bath is generally 1 to 10 g/l in terms of elemental copper. The amount of the source of ions containing the auxiliary metal used is generally 0.001 to 0.5 mol, preferably 0.01 to 0.3 mol per mol of the monovalent copper ions. The amount of sulfur-containing compound is generally 1 to 3 mols per mol of the monovalent copper ions.

As described previously, the electrically conducting material of this invention may also be prepared by treating a cyanic group-containing material carrying adsorbed copper sulfide with a source of ions containing the auxiliary metal and, optionally, a sulfur-containing compound (Group II methods).

The cyanic group-containing material with adsorbed copper sulfide is preferably prepared in accordance with the method described in U.S. Pat. No. 4,336,028, U.S. patent application Ser. No. 249,416 (filed Mar. 31, 1981) or U.S. patent application Ser. No. 260,129 (filed May 4, 1981), the disclosures of which are hereby incorporated by reference. Briefly, the method includes treating the above-mentioned cyanic group-containing material with (a) a source of monovalent copper ions of the type previously described and (c) a sulfur-containing compound of the type previously described. The treatment with the sulfur-containing compound is simultaneous with or preceded by the treatment with the source of monovalent copper ions.

The resultant material having adsorbed copper sulfide ($Cu_xS$ where x is in the range from 1 to 2 such as covellite (CuS), digenite ($Cu_{1.8}S$) or chalcosite ($Cu_2S$)) is then treated, as such or after being washed with water, in a bath containing the above mentioned source of ions containing the auxiliary metal. The concentration of the auxiliary metal-containing ions in the bath is generally in the range of 0.005–10 g/l, preferably 0.01–6 g/l in terms of the elemental metal. The treatment is performed at a temperature from room temperature to 100° C., preferably 30°–80° C., for a period of 0.5–20 hours, preferably 1–10 hours, with the ratio by weight of the bath to the material to be treated being in the range of 5:1 to 50:1, preferably 10:1 to 30:1.

It is preferred that the treatment with the auxiliary metal-containing ions be performed in the presence of the above-mentioned sulfur-containing compound or be followed by the treatment with the sulfur-containing compound to further improve both the stability and the electrical conductivity of the resulting electrically conducting material. The sulfur-containing compound is generally used in an amount of 0.2–5 mols, preferably 0.4–3 mols, per mol of the source of auxiliary metal-containing ions.

As a result of the foregoing treatments, sulfides of copper and the auxiliary metal are adsorbed by the cyanic group-containing material to form a continuous, electrically conducting layer or deposit at least on the surface thereof. The X-ray diffraction pattern of the electrically conducting material of this invention in which silver is used as the auxiliary metal has been found to differ from that deduced from the X-ray diffraction patterns of copper sulfide and silver sulfide. The analysis of the electrically conducting material by an X-ray microanalyzer indicates that the silver exists at the same locations as the copper and sulfur. Further, in view of the fact that the electrically conducting material of this invention is of a character which could not be predicted on the basis of the properties of a cyanic group-containing material having either copper sulfide or the sulfide of the auxiliary metal, the electrically conducting layer is not considered to be a mere mixture of copper sulfide and the sulfide of the auxiliary metal. Rather, it is believed that at least some of the copper and the auxiliary metal sulfides are present in a mixed crystal-like form in which the auxiliary metal is associated with the sulfur atom or atoms of the copper sulfide.

The amount of copper sulfide adsorbed by the cyanic group-containing material varies depending on the type of the starting cyanic group-containing material and the intended electrical conductivity but is generally in the range of about 0.5 to 30%, preferably 1 to 15%, in terms of elemental copper based on the weight of the starting cyanic group-containing material.

The amount of the sulfide of the auxiliary metal in the electrically conducting material of this invention is, in general, such that the atomic ratio M/Cu, where M stands for the auxiliary metal, is 0.0001 to 0.5, preferably 0.001–0.3, more preferably 0.01–0.2. Too small an amount of the auxiliary metal component is insufficient to attain an improvement in washability, whereas an amount of the auxiliary metal component in excess of a M/Cu atomic ratio 0.5 tends to lower the electrical conductivity and is also disadvantageous from an economic point of view since the auxiliary metal is very expensive.

In addition to the above-described auxiliary metal, iron, cobalt and nickel have been found to be effective in lightening the color of the electrically conducting material. Such a second metal component may be incorporated into the electrically conducting material in the same manner as the auxiliary metal component. Thus, a source of ions containing the second metal, such as a salt or complex thereof is added to the bath which is used for treating the cyanic group-containing material with the source of monovalent copper ion, the source of ions containing the auxiliary metal and/or the sulfur-containing compound. If desired, the incorporation of the second metal component may be effected independently of the above treatments by treating the cyanic group-containing material in the same manner and under the same conditions as in the case of the treatment with the source of ions containing the auxiliary metal. Regardless of the mode of incorporation, the amount of second metal-containing ions used will be generally 0.01 to 0.5 mol per mol of the monovalent copper ions.

The following examples further illustrate the present invention. In the examples, the washability was determined according to the method specified in Japanese Industrial Standard (JIS) L 1045. That is, a sample was washed with a liquid containing 3 g/l of a commercially available detergent ("All Temperature CHEER" of Proctor & Gamble Inc.) with a ratio by weight of the sample to the washing liquid of 1:50. In the washability tests, a dye-fastness testing device was employed together with ten stainless balls, with agitation at 50° C. for 30 min followed by washing with water and drying. Such a procedure was repeated a number of times for examination of fastness to washing. The alkali spotting test was conducted in accordance with JIS L 0864, i.e., a sample (1 part by weight) was immersed in an aqueous solution (30 parts by weight) containing 10 g/l of sodium carbonate, which was refluxed for one hour.

EXAMPLE 1

5 g of an acrylic fiber ("CASHMILON", 2 deniers, 51 millimeters in length of cut, type FWBR, made by Asahi Chemical Industry Co., Ltd., Japan) were immersed in 100 ml of an aqueous bath containing 20 g/l of cupric sulfate, 6 g/l of silver sulfate, 20 g/l of sodium thiosulfate, 20 g/l of sodium hydrogen sulfite, 30 g of disodium hydrogen phosphate and 12 g of citric acid, and heat-treated therewithin at a temperature of 50° C. for 5 hours. Subsequently, the fiber was thoroughly washed in water and dried to obtain a fiber having an electric resistivity of $1.2\times10^{-1}$ Ω-cm. The fiber withstood 100 washes. For the purpose of comparison, the above procedure was repeated in the same manner as described except that no silver sulfate was used. The resulting electrically conducting fiber failed to show a practically acceptable electrical conductivity after 40 washes.

EXAMPLE 2

5 g of polyacrylonitrile threads ("SILPALON", 100 deniers/40 filaments, Mitsubishi Rayon K.K.) were immersed in 100 ml of an aqueous bath containing 20 g/l of cupric sulfate, 3 g/l of nickel sulfate, 3 g/l of silver nitrate, 20 g/l of sodium thiosulfate, 10 g/l of sodium hydrogen sulfite, 30 g/l of disodium hydrogen phosphate and 12 g/l of citric acid, and heat-treated at 50° C. for 3 hours. The resulting threads were thoroughly washed with water and dried to obtain light brown-gray threads having an electric resistivity of $4.3\times10^{-1}$ Ω-cm. The threads withstood 80 washes. For the purpose of comparison, the above procedure was repeated in the same manner as described except that neither silver nitrate nor nickel sulfate was used. The resulting threads failed to show a practically acceptable electrical conductivity after 40 washes.

EXAMPLE 3

Example 1 was repeated in the same manner as described therein except that palladium chloride was used in place of silver sulfate. The resulting fiber had an electrical resistivity of $3\times10^{-1}$ Ω-cm and withstood 100 washes.

EXAMPLE 4

A polyhexamethylene adipamide film (BO #15, manufactured by Toray Co., Ltd.) having a thickness of 15 μm and weighing 2.5 g was immersed in 200 ml of an aqueous solution containing 10 g/l of ammonium persulfate and 10 g/l of sodium hydrogen sulfite at room temperature for 30 min. for adsorbing the catalyzer. The thus treated film was then placed in a stainless steel vessel into which was charged acrylonitrile vapor for effecting graft copolymerization of acrylonitrile onto the film at 38°–40° C. for 3 hours. The film having cyanic groups introduced thereinto was increased by 32.8% in weight. The resulting film was then immersed in a bath having the same composition as that of Example 1 for treatment at 50° C. for 5 hours, thereby to obtain a transparent film having a surface resistivity of 180 Ω. The fastness to alkali spotting of the film was found to be improved by two grades (from rank 2 to rank 4) in comparison with the control nylon film obtained in the same manner as described above except that no silver sulfate was employed.

EXAMPLE 5

A polyhexamethylene adipamide staple (BO #15, manufactured by Toray Co., Ltd.) was immersed in an aqueous solution containing 5 g/l of ammonium persulfate and 5 g/l of sodium hydrogen sulfite at room temperature for 30 min. for adsorbing the catalyzer. The thus treated staple was then placed in a stainless steel vessel into which was charged acrylonitrile vapor for effecting graft copolymerization of acrylonitrile onto the film at 38°–40° C. for 3 hours. The staple having cyanic groups introduced thereinto was increased by 25% in weight. 5 g of the resulting staple was then immersed in 100 ml of an aqueous bath containing 20 g/l of cupric sulfate, 3 g/l of ferrous sulfate, 4 g/l of silver nitrate, 20 g/l of sodium thiosulfate, 10 g/l of sodium hydrogen sulfite, 20 g/l of disodium hydrogen phosphate and 8 g/l of citric acid, and was heat-treated in the bath at 60° C. for 3 hours to obtain an electrically conducting staple. The fastness of the staple to alkali spotting was found to be improved by two grades (from rank 2 to rank 4) in comparison with the control nylon staple obtained in the same manner as described above except that no silver nitrate was employed.

EXAMPLE 6

Polyacrylonitrile powder was ground to a particle size of 10 μm or less and the ground powder was treated in the same manner as in Example 1. The thus treated polyacrylonitrile powder was found to have increased 12.0 wt % in weight. The electrically conducting powder was added into a vinyl chloride melt and the resulting melt, containing 5 wt % of the electrically conducting polyacrylonitrile, was then injected onto the surface of gloves formed of cotton. The gloves were effective in preventing problems caused by electrostatic charge.

EXAMPLE 7

Phthalonitrile crystals were ground to a particle size of 10 μm or less and 10 g of the ground phthalonitrile powder were treated in the same manner as described in Example 1. The resulting powder was washed with water and dried to obtain about 11.1 g of electrically conducting phthalonitrile powder. The electrically conducting powder was then incorporated into a commercially available acrylic paint (Acrylite No. 500) with a mixing ratio by weight of 1:1. The resulting paint was coated on an iron plate. The coating was found to have a surface electrical resistivity of $2\times10^{2}$ Ω. A radio wave was found to be attenuated by 25 dB upon reflection off of the surface of the coated iron plate. The coated iron plate was usable as a material for absorbing electromagnetic waves.

EXAMPLE 8

5 g of an acrylic fiber ("CASHMILON", 2 deniers, 51 millimeters in length of cut, made by Asahi Chemical Industry Co., Ltd., Japan) were immersed in 100 ml of an aqueous bath containing 30 g/l of cupric sulfate, 6 g/l of silver sulfate and 20 g/l of hydroxylamine sulfate. The bath was then heated from room temperature to 100° C. and maintained at that temperature for 60 minutes. After being thoroughly washed with water, the fiber was immersed in 100 ml of another aqueous bath containing 12 g/l of sodium dithionite. The bath was then heated from room temperature to 80° C. and maintained at that temperature for 3 hours. The electrically conducting fiber obtained after being thoroughly washed in water and dried had a light olive-brown color and an electrical resistivity of $8\times10^{-2}$ Ω-cm.

When this electrically conducting fiber was subjected to the repeated washing test, deterioration of its conductivity was hardly perceived even after 100 washes.

washability test results of the textile A are shown in Table 1 together with, for the purpose of comparison, those of the textile B obtained in the same manner as described above except that no palladium chloride was used.

TABLE 1

| Sample | Electrical Resistivity (Ω-cm) Number of Washing Operation | | | | | |
|---|---|---|---|---|---|---|
| | 0 | 10 | 20 | 30 | 40 | 50 |
| Textile A | $2.1\times10^{-1}$ | $2.3\times10^{-1}$ | $2.25\times10^{-1}$ | $2.7\times10^{-1}$ | $3.9\times10^{-1}$ | $5.1\times10^{-1}$ |
| Textile B | $1.8\times10^{-1}$ | $1.86\times10^{-1}$ | $2.5\times10^{2}$ | $5.3\times10^{4}$ | * | — |

*Electrical conductivity was lost.

EXAMPLE 9

An acrylic fiber ("CASHMILON", 2 deniers, 51 millimeters in length of cut, made by Asahi Chemical Industry Co., Ltd., Japan) was immersed in an aqueous bath containing 20 g/l of cupric sulfate, 6 g/l of silver sulfate, 3 g/l of cobalt sulfate and 15 g/l of hydroxylamine sulfate. The bath was gradually heated from room temperature to 90° C. and maintained at that temperature for 3 hours. After being washed with water, the resulting fiber was put into a closed receptacle having a gas inlet. Sulfur dioxide was fed into the receptacle until the pressure in the interior thereof reached 0.5 kg/cm$^2$ gauge pressure. Then, saturated vapor at 105° C. was fed into the receptacle until the pressure within the receptacle reached 1.0 kg/cm$^2$ gauge pressure. After having shut the receptacle tightly, the fiber was allowed to react therein at 110° C. for 90 min. It was taken out after cooling, washed thoroughly in water, and dried. The electrically conducting fiber thus obtained had a light olive-grey color. Its electrical resistivity was $3.2\times10^{-1}$ Ω-cm. The electrically conducting fiber was tested for washability and withstood 100 washes. The above procedure was repeated using hydrogen sulfide in place of sulfur dioxide to obtain almost the same results as above.

EXAMPLE 10

A copper sulfide-containing, electrically conducting fiber, obtained in accordance with the method described in Example 1 of U.S. Pat. No. 4,336,028, was immersed in an aqueous bath containing 5 wt % of silver nitrate, 15 wt % of sodium thiosulfate and 5 wt % of sodium sulfite with a ratio by weight of the fiber to the bath of 1:20, and heat-treated in the bath at 55° C. for 2 hours. The thus treated fiber withstood 100 washes while the non-treated electrically conducting fiber did not show practically acceptable electrical conductivity after 40 washes.

The above procedure was repeated using $PdCl_2$, $AuCl_3$ and $PtCl_4$ each in place of $AgNO_3$. The resulting fiber was found to be improved in washability.

EXAMPLE 11

5 g of a textile formed of an acrylic fiber ("SILPALON", 180 deniers/60 filaments) is immersed in 100 ml of an aqueous bath containing 6 g/l of hydroxylamine chloride, 20 g/l of cupric sulfate and 1 g/l of palladium chloride and treated therein at 98° C. for 1 hour. After being washed with water, the resulting textile is immersed in 100 ml of an aqueous solution containing 10 g/l of sodium thiosulfate for treatment at 95° C. for 2 hours. The thus treated textile was washed with water and dried to obtain an electrically conducting textile A having an electrical resistivity of $2.1\times10^{-1}$ Ω-cm. The The above procedure was repeated in the same manner as described above except that the palladium chloride was replaced with silver nitrate, silver sulfate, gold chloride and platinum chloride, respectively, whereby an improvement in washability was attained in each resultant textile.

EXAMPLE 12

A copper sulfide-carrying, electrically conducting fiber, obtained in the same manner as described in Example 1 of U.S. Pat. No. 4,336,028 except that the concentrations of cupric sulfate, sodium thiosulfate and sodium hydrogen sulfite were each reduced in half, was immersed in an aqueous silver nitrate solution having different concentrations and treated at a temperature of 50° C. for 2 hours to obtain seven kinds of electrically conducting fibers with different atomic ratios Ag/Cu as shown in Table 2. Each sample was subjected to the washability test with the results shown in Table 2.

TABLE 2

| Ag/Cu atomic ratio | Electrical Resistivity (Ω-cm) Number of Washes | | | |
|---|---|---|---|---|
| | 0 | 10 | 30 | 50 |
| 0 | $1.16\times10^{-1}$ | $1.65\times10^{-1}$ | $3.86\times10^{6}$ | * |
| 0.0005 | $1.14\times10^{-1}$ | $1.21\times10^{-1}$ | $2.6\times10^{2}$ | $5.8\times10^{5}$ |
| 0.0011 | $1.27\times10^{-1}$ | $1.26\times10^{-1}$ | $1.8\times10^{-1}$ | $4.2\times10^{-1}$ |
| 0.013 | $1.29\times10^{-1}$ | $1.30\times10^{-1}$ | $1.36\times10^{-1}$ | $1.9\times10^{-1}$ |
| 0.16 | $2.14\times10^{-1}$ | $2.12\times10^{-1}$ | $2.21\times10^{-1}$ | $2.6\times10^{-1}$ |
| 0.31 | $3.6\times10^{1}$ | $3.6\times10^{1}$ | $3.5\times10^{1}$ | $3.7\times10^{1}$ |
| 0.42 | $6.36\times10^{3}$ | $6.40\times10^{3}$ | $6.28\times10^{3}$ | $6.5\times10^{3}$ |

*Electrical conductivity was lost.

We claim:

1. A process for the preparation of an electrically conducting material, said process comprising:
   (a) providing a cyanic group-containing material selected from the group consisting of organic polymers, phthalonitrile, isophthalonitrile, N-cyanomethyl aniline and N-β-cyanoethylaniline;
   (b) treating said cyanic group-containing material with a source of monovalent copper ions to absorb said copper on said cyano group containing material;
   (c) treating said cyanic group-containing material with a source of ions containing an auxiliary metal selected from the group consisting of silver, gold and elements of the platinum group; and
   (d) simultaneous with or subsequent to step (b), treating said cyanic group-containing material with a sulfur-containing compound, whereby sulfides of copper and the auxiliary metal are formed and are adsorbed by the cyanic group-containing material.

2. A process as claimed in claim 1, wherein the treatment with component (a) is simultaneous with the treatment with component (b) and prior to the treatment with component (c).

3. A process as claimed in claim 1, wherein the treatment with component (b) is simultaneous with the treatment with component (c) and is separate from and subsequent to the treatment with component (a).

4. A process as claimed in claim 1, wherein the treatment with components (a), (b) and (c) is within the same treating bath.

5. A process as claimed in claim 1, wherein said source of monovalent copper ions is a combination of a copper compound and a reducing agent capable of reducing bivalent copper ions into monovalent copper ions.

6. A process as claimed in claim 5, wherein said reducing agent is selected from the group consisting of metallic copper, hydroxylamine, a salt of hydroxylamine, ferrous sulfate, ammonium vanadate, furfural, sodium hypophosphite, glucose and mixtures thereof.

7. A process as claimed in claim 1, wherein said sulfur-containing compound is selected from the group consisting of sodium sulfide, sulfur dioxide, sodium hydrogen sulfite, sodium pyrosulfite, sulfurous acid, dithionous acid, sodium dithionite, sodium thiosulfate, thiourea dioxide, hydrogen sulfide, sodium formaldehyde sulphoxylate, zinc formaldehyde sulphoxylate and mixtures thereof.

8. A method of improving the stability of the electrical conductivity of a copper sulfide-carrying, cyanic group-containing selected from the group consisting of organic polymers, phthalonitrile, isophthalonitrile, N-cyanomethyl aniline and N-$\beta$-cyanoethylaniline material, comprising treating said cyanic group-containing material with a source of ions containing an auxiliary metal selected from the group consisting of silver, gold and elements of the platinum group.

9. A method as claimed in claim 8, wherein said treatment is conducted in the presence of a sulfur-containing compound.

10. A method as claimed in claim 8, wherein said treatment is followed by a treatment with a sulfur-containing compound.

11. A method as claimed in claim 9, wherein said sulfur-containing compound is selected from the group consisting of sodium sulfide, sulfur dioxide, sodium hydrogen sulfite, sodium pyrosulfite, sulfurous acid, dithionous acid, sodium dithionite, sodium thiosulfate, thiourea dioxide, hydrogen sulfide, sodium formaldehyde sulphoxylate, zinc formaldehyde sulphoxylate and mixtures thereof.

12. The product produced by the process of claim 1.

13. The product produced by the process of claim 8.

* * * * *